US010565831B2

(12) United States Patent
Bolling, Jr.

(10) Patent No.: US 10,565,831 B2
(45) Date of Patent: Feb. 18, 2020

(54) WAGER MACHINE WITH AN EVENT TRIGGERED BASED ON TRADED SYMBOLS

(71) Applicant: Aristocrat Technologies Australia Pty Limited, North Ryde (AU)

(72) Inventor: T. Grant Bolling, Jr., Reno, NV (US)

(73) Assignee: ARISTOCRAT TECHNOLOGIES AUSTRALIA PTY LIMITED, North Ryde, NSW (AU)

( * ) Notice: Subject to any disclaimer, the term of this patent is extended or adjusted under 35 U.S.C. 154(b) by 0 days.

(21) Appl. No.: 15/978,999

(22) Filed: May 14, 2018

(65) Prior Publication Data

US 2019/0347908 A1 Nov. 14, 2019

(51) Int. Cl.
*A63F 9/00* (2006.01)
*G07F 17/34* (2006.01)
*G07F 17/32* (2006.01)

(52) U.S. Cl.
CPC ..... *G07F 17/34* (2013.01); *G07F 17/3213* (2013.01); *G07F 17/3267* (2013.01)

(58) Field of Classification Search
None
See application file for complete search history.

(56) References Cited

U.S. PATENT DOCUMENTS 8,496,524 B2 7/2013 Vancura
8,764,537 B2 * 7/2014 Jaffe ..... G07F 17/34 273/138.1
8,905,831 B2 12/2014 Lafky et al.
9,196,119 B2 * 11/2015 Parham ..... G07F 17/32
9,466,179 B2 10/2016 Englman et al.
2003/0216165 A1 * 11/2003 Singer ..... G07F 17/3211 463/20
2006/0068893 A1 * 3/2006 Jaffe ..... G07F 17/3244 463/20
2006/0197279 A1 * 9/2006 Shimizu ..... G07F 17/32 273/143 R
2007/0060329 A1 3/2007 Martin
2009/0069063 A1 * 3/2009 Thomas ..... G07F 17/3244 463/16
2011/0065493 A1 * 3/2011 Parham ..... G07F 17/32 463/20

(Continued)

*Primary Examiner* — Seng Heng Lim
(74) *Attorney, Agent, or Firm* — McAndrews, Held & Malloy, Ltd.

(57) ABSTRACT

A gaming machine includes a credit input mechanism, a display device, symbol meters, a player interface, and a game controller. The player interface generates input signals representative of a trade offer. The trade offer specifies a first set of bonus symbols accumulated by the first symbol meters to be traded for a second set of bonus symbols accumulated by another gaming machine. The game controller randomly generates a game outcome displayed by the display device, and accumulates respective bonus symbols of the game outcome among the first symbol meters. In response to an acceptance of the trade offer, the game controller removes the first set of bonus symbols from the first symbol meters and adds the second set of bonus symbols to the first symbol meters. The game controller further triggers an event in response to the first symbol meters accumulating a winning set of bonus symbols.

20 Claims, 8 Drawing Sheets

(56) References Cited

U.S. PATENT DOCUMENTS

| | | | | |
|---|---|---|---|---|
| 2012/0122531 | A1* | 5/2012 | Aoki | G07F 17/3258 463/7 |
| 2015/0038213 | A1* | 2/2015 | Meyer | G07F 17/34 463/20 |
| 2015/0099575 | A1* | 4/2015 | Elias | G07F 17/3262 463/25 |
| 2016/0055702 | A1 | 2/2016 | Arnone et al. | |
| 2017/0206735 | A1 | 7/2017 | Arnone et al. | |

* cited by examiner

400

| Stop # | Reel 1 (410A) | Reel 2 (410B) | Reel 3 (410C) | Reel 4 (410D) | Reel 5 (410E) |
|---|---|---|---|---|---|
| 19 | | | C | | |
| 18 | | | C | | |
| 17 | | | B | | |
| 16 | A | | A | | |
| 15 | D | | G | | |
| 14 | E | A | F | | |
| 13 | F | C | D | | D |
| 12 | C | B | E | | B |
| 11 | D | A | C | D | C |
| 10 | B | E | D | D | A |
| 9 | C | D | A | C | B |
| 8 | A | C | B | B | D |
| 7 | B | A | B | D | E |
| 6 | A | B | C | C | F |
| 5 | A | A | B | D | A |
| 4 | B | B | C | A | B |
| 3 | A | C | C | B | D |
| 2 | C | A | A | E | E |
| 1 | B | B | C | E | C |
| 0 | B | B | A | D | E |

330

FIG. 4

WAGER MACHINE WITH AN EVENT TRIGGERED BASED ON TRADED SYMBOLS

BACKGROUND

Electronic gaming machines (EGMs) or gaming machines provide a variety of wagering games such as slot games, video poker games, video blackjack games, roulette games, video bingo games, keno games and other types of games that are frequently offered at casinos and other locations. Play on EGMs typically involves a player establishing a credit balance by inputting money, or another form of monetary credit, and placing a monetary wager (from the credit balance) on one or more outcomes of an instance (or single play) of a primary or base game. In many games, a player may qualify for bonus games or bonus rounds by attaining a certain winning combination or by otherwise triggering an event in the base game. Bonus games provide an opportunity to win additional game instances, credits, awards, jackpots, progressives, etc. Awards from any winning outcomes are typically added back to the credit balance and can be provided to the player upon completion of a gaming session or when the player wants to "cash out."

Typical games use a random number generator (RNG) to randomly determine the outcome of each game. The game is designed to return a certain percentage of the amount wagered back to the player (RTP=return-to-player) over the course of many plays or instances of the game. The RTP and randomness of the RNG are critical to ensuring the fairness of the games and are therefore highly regulated. Upon initiation of play, the RNG randomly determines a game outcome and symbols are then selected which correspond to that outcome. Notably, some games may include an element of skill on the part of the player and are therefore not entirely random.

Some aspects of the present disclosure address technical problems associated with maintaining RTP requirements while permitting players to trade symbols or other assets acquired during a gaming session.

SUMMARY

Some aspects of the present disclosure are directed to a gaming machine from a plurality of linked gaming machines. The gaming machine may include a credit input mechanism, a display device, one or more symbols meters, a player interface, and a game controller. The credit input mechanism may be configured to receive a physical item representing a monetary value. The display device may be configured to display a game outcome. Each symbol meter of the first one or more symbol meters may be configured to accumulate a respective bonus symbol. The player interface may be configured to generate input signals representative of a trade offer. The trade offer may specify a first set of bonus symbols accumulated by the one or more symbol meters to be traded for a second set of bonus symbols accumulated by another gaming machine from the plurality of linked gaming machines.

The game controller may be configured to increase a credit balance of a credit meter based on the monetary value of the physical item received by the credit input mechanism, and decrease the credit balance based on a wager on the game outcome. The game controller may be further configured to randomly generate the game outcome displayed by the display device, and accumulate, among the one or more symbol meters, respective bonus symbols awarded based on the game outcome. In response to an acceptance of the trade offer, the game controller may be configured to remove the first set of symbols from the one or more symbol meters and add the second set of bonus symbols to the one or more symbol meters. The game controller may also be configured to trigger an event in response to the one or more symbol meters accumulating a winning set of bonus symbols, and increase the credit balance based on an award associated with the game outcome.

Further aspects of the present disclosure may be directed to a method for playing a game of a gaming machine from a plurality of linked gaming machines. The method may include increasing a credit balance of a credit meter of the gaming machine based on a monetary value of a physical item received by a credit input mechanism of the gaming machine, and decreasing the credit balance based on a wager on a game outcome of the gaming machine. The method may also include randomly generating the game outcome, and displaying the game outcome on a display device of the gaming machine. The method may further include accumulating, among one or more symbol meters, respective bonus symbols awarded based on the game outcome.

The method may also include generating input signals representative of a trade offer received via a player interface of the gaming machine, the trade offer specifying a first set of bonus symbols accumulated by the one or more symbol meters to be traded for a second set of bonus symbols accumulated by another gaming machine from the plurality of linked gaming machines. In response to an acceptance of the trade offer, the method may further include removing the first set of bonus symbols from the one or more symbol meters and adding the second set of bonus symbols to the one or more symbol meters. Further yet, the method may include triggering an event in response to the one or more symbol meters accumulating a winning set of bonus symbols, and increasing the credit balance based on an award associated with the game outcome.

Various advantages, aspects, and novel features of the present disclosure, as well as details of illustrated embodiments thereof, will be more fully understood from the following description and drawings.

BRIEF DESCRIPTION OF THE DRAWINGS

In the drawings, various dimensions may be exaggerated for illustrative clarity. Additionally, like reference numbers are utilized to refer to like elements throughout the present disclosure.

FIG. 4 depicts exemplary reel strips carried by the reels of FIG. 3.

DETAILED DESCRIPTION

Various aspects of the present disclosure are directed to electronic gaming systems and gaming machines for waging. In particular, a gaming machine may be configured to trigger an event in response to symbol meters accumulating a winning set of bonus symbols. In response to triggering the event, the gaming machine may provide the player of the gaming machine with a bonus game, higher awards in a current game, and/or some other benefit. The gaming machine may further permit a player to trade one or more bonus symbols accumulated on the symbol meters for bonus symbols accumulated by another gaming machine. In particular, the player may trade away unwanted bonus symbols to obtain other bonus symbols that complete a winning set of bonus symbols. In this manner, the player may be able to obtain a winning set of bonus symbols sooner than if the player were not permitted to trade bonus symbols.

As utilized herein, "and/or" means any one or more of the items in the list joined by "and/or". As an example, "x and/or y" means any element of the three-element set {(x), (y), (x, y)}. In other words, "x and/or y" means "one or both of x and y." As another example, "x, y, and/or z" means any element of the seven-element set {(x), (y), (z), (x, y), (x, z), (y, z), (x, y, z)}. In other words, "x, y and/or z" means "one or more of x, y, and z."

As used herein, the singular forms are intended to include the plural forms as well, unless the context clearly indicates otherwise. The terms "comprises," "includes," "comprising," "including," "has," "have," "having," and the like when used in this specification, specify the presence of stated features, integers, steps, operations, elements, and/or components, but do not preclude the presence or addition of one or more other features, integers, steps, operations, elements, components, and/or groups thereof.

Although the terms first, second, etc. may be used herein to describe various elements, these elements should not be limited by these terms. These terms are only used to distinguish one element from another element. Thus, for example, a first element, a first component, or a first section could be termed a second element, a second component, or a second section without departing from the teachings of the present disclosure. Similarly, various spatial terms, such as "upper," "lower," "side," and the like, may be used in distinguishing one element from another element in a relative manner. However, components can be oriented in different manners. For example, a component can be turned sideways so that its "top" surface is facing horizontally and its "side" surface is facing vertically, without departing from the teachings of the present disclosure.

Figure 1:
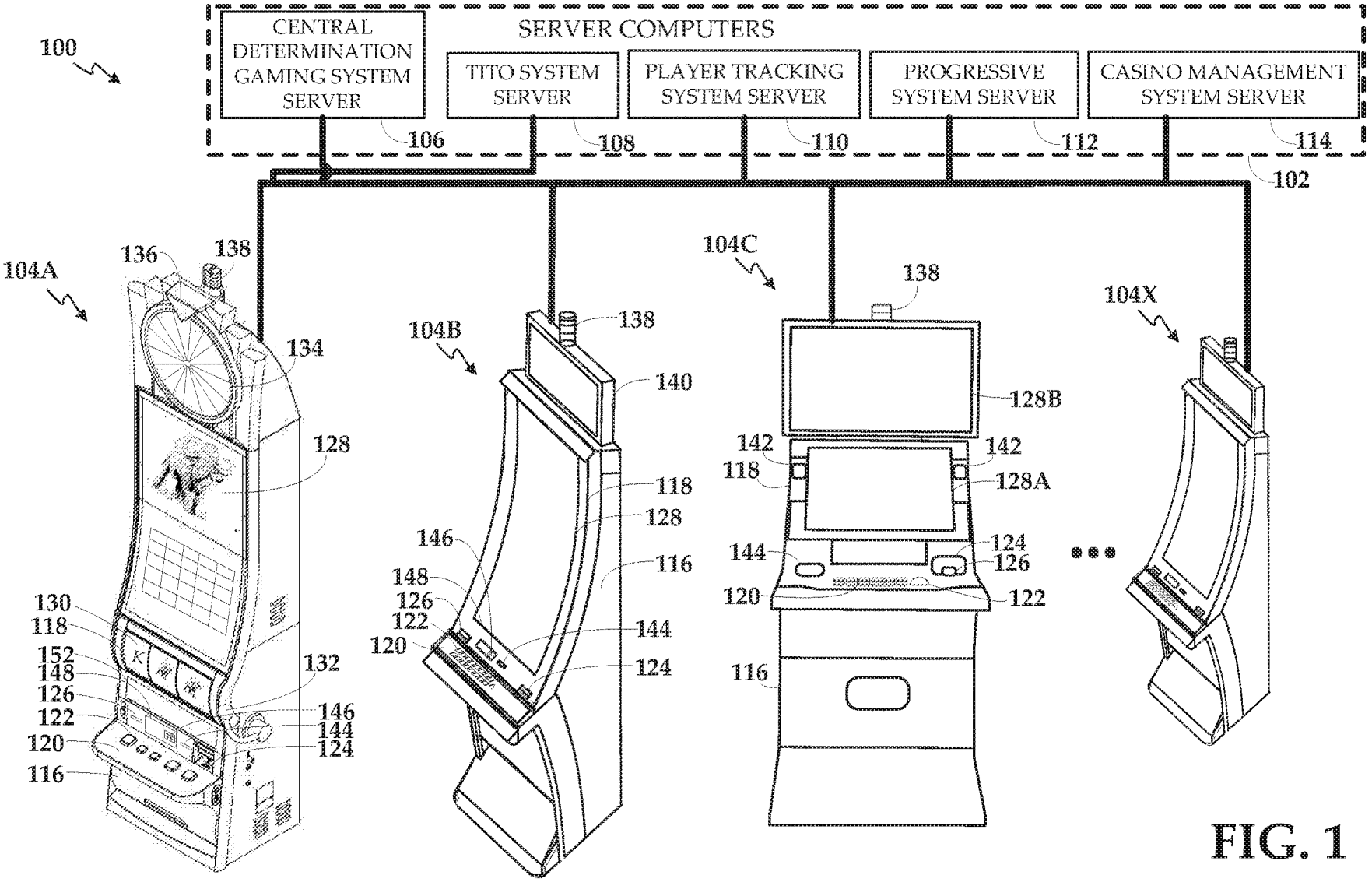
FIG. 1 depicts a gaming system in accordance with various aspects of the present disclosure.

FIG. 1 illustrates several different models of electronic gaming machines or electronic gaming machines (EGMs), which may be networked to various gaming related servers. Various embodiments of the present disclosure may be configured to work as a gaming system 100 that includes one or more server computers 102 (e.g., slot servers of a casino) that are in communication, via a communications network, with one or more gaming machines 104A-104X (EGMs, slots, video poker, bingo machines, etc.). The gaming machines 104A-104X may alternatively be portable and/or remote gaming machines such as, but not limited to, a smart phone, a tablet, a laptop, a game console, etc.

Communication between the gaming machines 104A-104X and the server computers 102, and among the gaming machines 104A-104X, may be direct or indirect, such as over the Internet through a website maintained by a computer on a remote server or over an online data network including commercial online service providers, Internet service providers, private networks, and the like. In other embodiments, the gaming machines 104A-104X may communicate with one another and/or the server computers 102 over RF, cable TV, satellite links, and the like.

In some embodiments, server computers 102 may not be necessary and/or preferred. For example, one or more embodiments of the present disclosure may be practiced on a stand-alone gaming machine such as gaming machine 104A, gaming machine 104B, or any of the other gaming machines 104C-104X. However, it is typical to find multiple EGMs connected to networks implemented with one or more of the different server computers 102 as described herein.

The server computers 102 may include a central determination gaming system server 106, a ticket-in-ticket-out (TITO) system server 108, a player tracking system server 110, a progressive system server 112, and/or a casino management system server 114. Gaming machines 104A-104X may include features to enable operation of any or all servers for use by the player and/or operator (e.g., the casino, resort, gaming establishment, tavern, pub, etc.). For example, game outcomes may be generated on a central determination gaming system server 106 and then transmitted over the network to any of a group of remote terminals or remote gaming machines 104A-104X that utilize the game outcomes and display the results to the players.

As depicted, the gaming machine 104A is of a cabinet construction. Moreover, the gaming machine 104A may be aligned in rows or banks of similar devices for placement and operation on a casino floor. The gaming machine 104A may include a main door 116, which provides access to the interior of the cabinet. Gaming machine 104A may also include a button area or button deck 120 accessible by a player. The button area or deck 120 may include input switches or buttons 122 of a player interface, an access channel for a bill validator 124, and/or an access channel for a ticket printer 126.

In FIG. 1, the gaming machine 104A is shown as a Relm XL™ model gaming machine manufactured by Aristocrat® Technologies, Inc. As shown, the gaming machine 104A is a reel machine having a gaming display area 118 comprising a number (typically 3 or 5) of mechanical reels 130 with various symbols displayed on them. The reels 130 are independently spun and stopped to show a set of symbols within the gaming display area 118 which may be used to determine an outcome to the game.

In some embodiments, the gaming machine 104A may have a main display 128 (e.g., video display monitor) mounted to, or above, the gaming display area 118. The main display 128 may include a high-resolution LCD, plasma, LED, and/or OLED panel, which may be flat or curved as shown. In some embodiment, the main display 128 may include a cathode ray tube, or other conventional electronically controlled video monitor.

In some embodiments, the bill validator 124 may also function as a "ticket-in" reader that allows the player to use a casino issued credit ticket to load credits onto the gaming machine 104A (e.g., in a cashless ticket ("TITO") system). In such cashless embodiments, the gaming machine 104A may also include a "ticket-out" printer 126 for outputting a credit ticket when a "cash out" button is pressed. Cashless TITO systems are used to generate and track unique barcodes or other indicators printed on tickets to allow players to avoid the use of bills and coins by loading credits using a ticket reader and cashing out credits using a ticket-out printer 126 on the gaming machine 104A.

In some embodiments, a player tracking card reader 144, a transceiver for wireless communication with a player's smart phone, a keypad 146, and/or an illuminated display 148 for reading, receiving, entering, and/or displaying player tracking information is provided in EGM 104A. In such embodiments, a game controller within the gaming machine 104A may communicate with the player tracking server system 110 to send and receive player tracking information.

The gaming machine 104A may also include a bonus topper wheel 134. When a bonus game is triggered (e.g., by a player achieving a particular outcome or set of outcomes in the base game), bonus topper wheel 134 may spin and stop with indicator arrow 136 to indicate the outcome of the bonus game. Bonus topper wheel 134 may used to play a bonus game, but the bonus topper wheel 134 may also be incorporated into play of the base or primary game.

A candle 138 may be mounted on the top of the gaming machine 104A and may be activated by a player (e.g., using a switch or button 122) to indicate to operations staff that gaming machine 104A has experienced a malfunction or the player requires service. The candle 138 may also be used to indicate a jackpot has been won and to alert staff that a hand payout of an award may be needed.

The gaming machine 104 may also include one or more information panels 152, which may be a back-lit, silk-screened glass panel with lettering to indicate general game information such as, for example, a game denomination (e.g., $0.25 or $1), pay lines, pay tables, and/or various game related graphics. In some embodiments, the information panel(s) 152 may be implemented as an additional video display.

The gaming machine 104A may further include a handle 132 of the player interface typically mounted to the side of main cabinet 116 which may be used to initiate game play.

Figure 2:
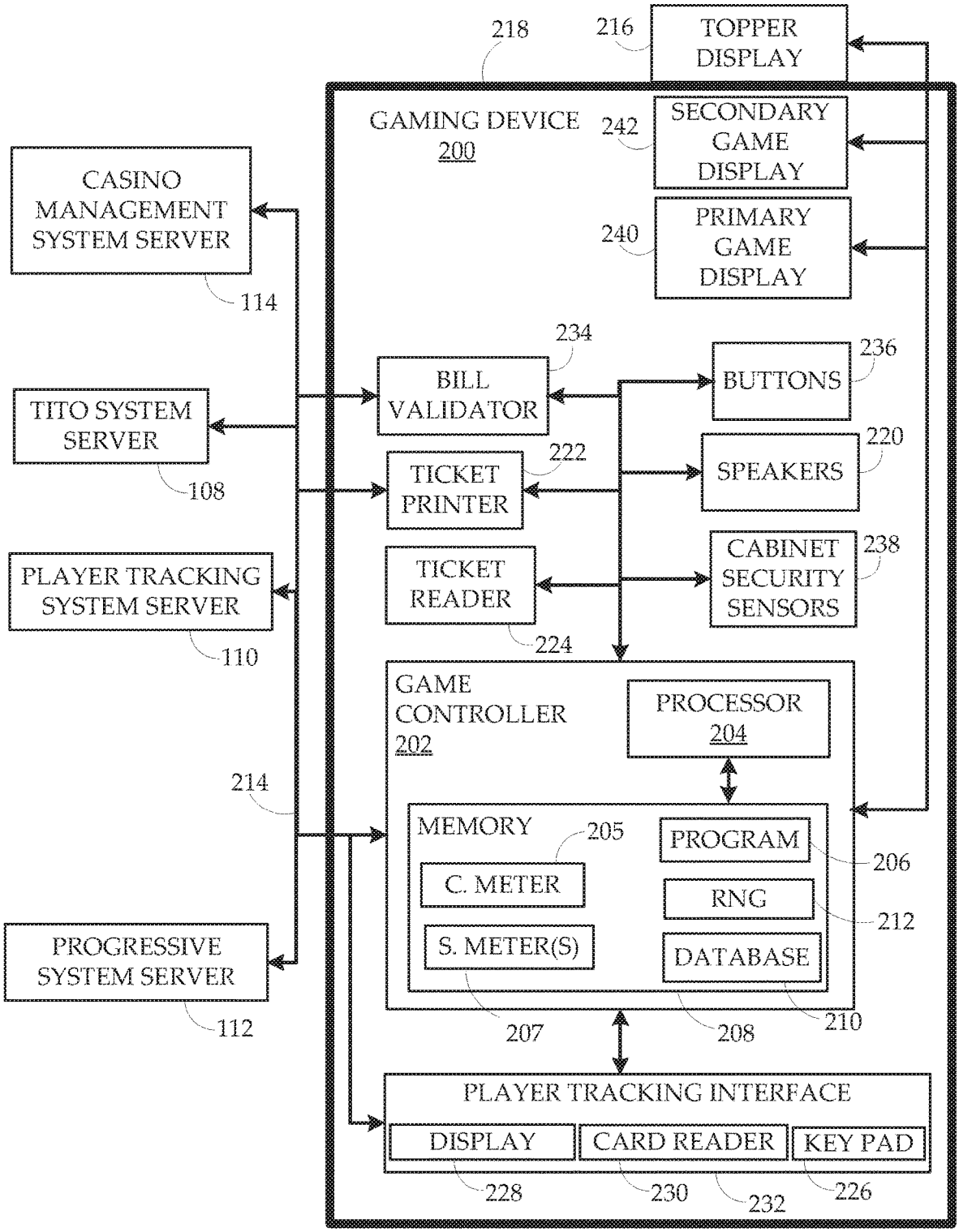
FIG. 2 depicts an exemplary gaming machine of the gaming system of FIG. 1.

Many or all the above described components may be controlled by circuitry (e.g., a gaming controller) housed inside the main cabinet 116 of the gaming machine 104A, the details of which are shown in FIG. 2.

Note that not all gaming machines suitable for implementing embodiments of the present disclosure necessarily include top wheels, top boxes, information panels, cashless ticket systems, and/or player tracking systems. Further, some suitable gaming machines have only a single display that includes mechanical reels and/or a video display, while others are designed for bar counters or table tops and have displays that face upwards.

An alternative example gaming machine 104B illustrated in FIG. 1 is the Arc™ model gaming machine manufactured by Aristocrat® Technologies, Inc. Note that where possible, similar features of the gaming machines 104A, 104B are referenced using the same reference numbers. The gaming machine 104B does not include physical reels and instead shows game play functions on main display 128. An optional topper screen 140 may be used as a secondary display for a bonus game, to show game features or attraction activities while a game is not in play, or any other information or media desired by the game designer or operator. In some embodiments, the topper screen 140 may also or alternatively be used to display progressive jackpot prizes available to a player during play of gaming machine 104B.

The gaming machine 104B may include a main cabinet 116 including a main door 118, which opens to provide access to the interior of the gaming machine 104B. The main or service door 118 may be used by service personnel to refill the ticket-out printer 126 and collect bills and tickets inserted into the bill validator 124. The door 118 may also be used to reset the machine, verify and/or upgrade the software, and for general maintenance operations.

Another example gaming machine 104C shown is the Helix™ model gaming machine manufactured by Aristocrat® Technologies, Inc. The gaming machine 104C may include a main display 128A that is in a landscape orientation. Although not illustrated due to the provided front view, the landscape display 128A may have a curvature radius from top to bottom, or alternatively from side to side. In some embodiments, the display 128A may include a flat panel display. The main display 128A may be used for a base game while the secondary display 128B may be used for bonus game, to show game features or attraction activities while the game is not in play or any other information or media desired by the game designer or operator.

Many different types of games, including mechanical slot games, video slot games, video poker, video black jack, video pachinko, keno, bingo, and lottery, may be provided with or implemented within the depicted gaming machines 104A-104C and other similar gaming machines. Each gaming machine 104A-104C may also be operable to provide many different games. Games may be differentiated according to themes, sounds, graphics, type of game (e.g., slot game vs. card game vs. game with aspects of skill), denomination, number of pay lines, maximum jackpot, progressive or non-progressive, bonus games, and may be deployed for operation in Class II or Class III gaming establishments.

FIG. 2 is a block diagram depicting exemplary internal electronic components of a gaming machine 200 connected to various external systems. All or parts of the example gaming machine 200 shown may be used to implement any one of the example gaming machines 104A-X depicted in FIG. 1. The games available for play on the gaming machine 200 are controlled by a game controller 202 that includes one or more processors 204 for executing instructions of game software or programs 206 stored in memory 208. The memory 208 may include one or more mass storage devices or media that are housed within gaming machine 200. Within the mass storage devices and/or memory 208, one or more databases 210 may be provided for use by the program 206.

The memory 208 may further maintain various meters such as a credit meter 205 and one or more symbol meters 207. The credit meter 205 may maintain a credit balance from which wagers are funded. The symbol meters 207 may collect or accumulate certain symbols presented during play of a base game or some other game. Further details regarding the symbol meters 207 are discussed below.

The gaming machine 200 may further include one or more random number generators (RNG) 212. The RNG 212 may be used to generate random numbers that are used in the operation of game play to ensure that game play outcomes are random and meet regulations for a game of chance. To this end, the RNG 212 may be implemented in hardware and/or software. Alternatively, a game instance (i.e. a play or round of the game) may be generated on a remote gaming machine such as a central determination gaming system server 106 (not shown in FIG. 2 but see FIG. 1). The game instance may be communicated to the gaming machine 200 via the network 214 and then displayed on gaming machine 200. The gaming machine 200 may execute game software, such as but not limited to video streaming software that allows the game to be displayed on the gaming machine 200. When a game is stored on the gaming machine 200, the game may be loaded from a memory 208 (e.g., from a read only memory (ROM)) or from the central determination gaming system server 106 to memory 208. The memory 208 may include RAM, ROM, or another form of storage media that stores instructions for execution by the processor 204.

The gaming machine 200 may include a topper display 216 or another form of a top box (e.g., a topper wheel, a topper screen, etc.) which sits above main cabinet 218. The gaming cabinet 218 or topper display 216 may also house a number of other components which may be used to add features to a game being played on gaming machine 200, including speakers 220, a ticket printer 222 which prints bar-coded tickets or other media or mechanisms for storing or indicating a player's credit value, a ticket reader 224 which reads bar-coded tickets or other media or mechanisms for storing or indicating a player's credit value, and a player tracking interface 232. The player tracking interface 232 may include a keypad 226 for entering information, a player tracking display 228 for displaying information (e.g., an illuminated or video display), a card reader 230 for receiving data and/or communicating information to and from media or a device such as a smart phone enabling player tracking. Ticket printer 222 may be used to print tickets for a TITO system server 108. The gaming machine 200 may further include a bill validator 234, buttons 236 of a player interface, cabinet security sensors 238 to detect unauthorized opening of the cabinet 218, a primary display 240, and a secondary display 242, each coupled to and operable under the control of game controller 202.

The gaming machine 200 may be connected over network 214 to player tracking system server 110. The player tracking system server 110 may be, for example, an OASIS® system manufactured by Aristocrat® Technologies, Inc. The player tracking system server 110 may be used to track play (e.g. amount wagered, games played, time of play, and/or other quantitative or qualitative measures) for individual players so that an operator may reward players in a loyalty program. The player may use the player tracking interface 232 to access his/her account information, activate free play, and/or request various information. The player tracking or loyalty programs seek to reward players for their play and help build brand loyalty to the gaming establishment. The rewards typically correspond to the player's level of patronage (e.g., to the player's playing frequency and/or total amount of game plays at a given casino). The player tracking rewards may include complimentary and/or discounted meals, lodging, entertainment, and/or additional play. The player tracking information may be combined with other information readily obtainable by a casino management system.

The gaming machines, such as gaming machines 104A-104X, 200, are highly regulated to ensure fairness and, in many cases, gaming machines 104A-104X, 200 are operable to award monetary awards (e.g., typically dispensed in the form of a redeemable voucher). Therefore, to satisfy security and regulatory requirements in a gaming environment, hardware and software architectures are implemented in gaming machines 104A-104X, 200 that differ significantly from those of general-purpose computers. Adapting general purpose computers to function as gaming machines 200 is not simple or straightforward because of: 1) the regulatory requirements for gaming machines 200, 2) the harsh environment in which gaming machines 200 operate, 3) security requirements, 4) fault tolerance requirements, and 5) the requirement for additional special purpose components to enable functionality of an EGM. These differences require substantial engineering effort with respect to game design implementation, hardware components, and/or software.

When a player wishes to play the gaming machine 200, he/she can insert cash or a ticket voucher through a coin acceptor (not shown) or bill validator 234 to establish a credit balance on the gamine machine. The credit balance may be used by the player to place wagers on instances of the game and to receive credit awards based on the outcome of winning instances. The gaming machine 20 may increase the credit balance by the amount of each wager and may increase the credit balance upon a win. The player may further add additional credits to the credit balance at any time. The player may also optionally insert a loyalty club card into the card reader 230. During the game, the player may view the game outcome on the displays 240, 242. Other game and prize information may also be displayed. As explained in greater detail below, the primary display 240 and/or the secondary display 242 may further present one or more symbol meters 207. Such symbol meters 207 may accumulate certain symbols presented on the displays 240, 242 during game play.

For each game instance, a player may make selections, which may affect play of the game. For example, the player may vary the total amount wagered by selecting the amount bet per line and the number of lines played. In many games, the player is asked to initiate or select options during course of game play (such as spinning a wheel to begin a bonus round or selecting various items during a feature game). The player may make these selections using the player-input buttons 236, the primary display 240 which may include a touch screen and/or using some other device of a player interface which enables a player to input information into the gaming machine 200.

During certain game events, the gaming machine 200 may display visual and auditory effects that may be perceived by the player. These effects may add to the excitement of a game, which makes a player more likely to enjoy the playing experience. Auditory effects may include various sounds that are projected by the speakers 220. Visual effects may include flashing lights, strobing lights, and/or other patterns displayed from lights on the gaming machine 200 or from lights behind the information panel 152 (FIG. 1).

When the player is done, he/she may cash out the credit balance by, for example, pressing a cash out button to receive a ticket from the ticket printer 222. The ticket may be "cashed-in" for money or inserted into another machine to establish a credit balance for play.

As explained in further detail below, the gaming machine 200 may trigger an event based on traded symbols. In particular, the gaming machine 200 may provide a base game, feature game, secondary game, bonus game, or some other game in which players may accumulate symbols from a series of game outcomes. The gaming machine 200 may include symbol meters 207, which collect symbols from the series of game outcomes. The gaming machine 200 may further trigger an event based on the accumulated or otherwise collected symbols. In some embodiments, the gaming machine 200 may trigger the event in response to the symbol meters 207 collecting a winning symbol set such as, for example, a predetermined number of the same symbol (e.g., four of kind), a predetermined number of each symbol (e.g. one symbol from each of four distinct symbols), or some other predetermined combination of accumulated symbols.

In one embodiment, the symbol meters 207 and trading aspects are provided as part of a slot or spinning reel base game. However, other base games, feature games, bonus games, secondary games, etc. may incorporate aspects of the disclosed symbol meters 207 and/or symbol trading.

Figure 3:
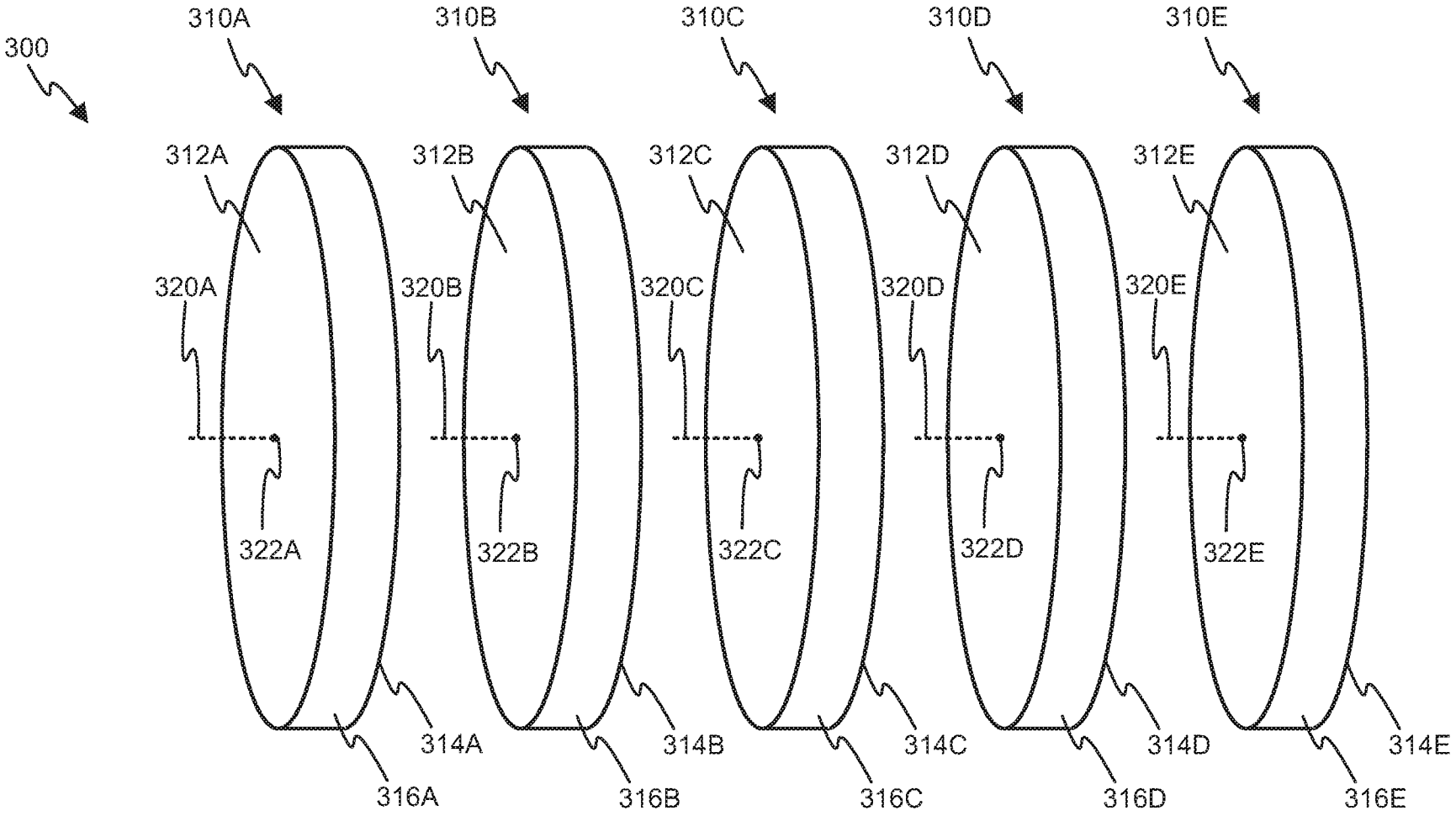
FIG. 3 depicts an exemplary set of reels used by the gaming machine of FIG. 2.

Referring now to FIG. 3, an exemplary arrangement 300 of reels 310A, 310B, 310C, 310D, 310E is presented. Such depiction of reels 310A-310E is generally applicable to the gaming machine 200 regardless of whether the reels 310A-310E are implemented as mechanical reels or as virtual reels (e.g., a simulation or animation of reels displayed upon a video display device). As shown, the arrangement 300 may include five reels 310A-310E, though arrangements having a different number of reels (e.g., three, four, etc.) are contemplated. In the exemplary arrangement 300, each reel 310A-310E may have a right circular cylindrical shape comprising circular ends 312A-312E, 314A-314E connected by a cylindrical outer surface 316A-316E. However, other embodiments of reels 310A-310E may utilize a different right cylindrical shape in which the ends 312A-312E do not have a circular shape but instead have a regular polygonal shape or have another shape. As further shown, each reel 310A-310E includes an axis of rotation 320A-320E that passes through a central point 322A-322E of ends 312A-312E. The reels 310A-310E may be mounted in a side-by-side manner across the primary display 240 such that their axes of rotation 320A-320E are arranged along a common axis that spans horizontally across the primary display 240.

The outer surface 316A-316E of each reel 310A-310E may carry a reel strip such as reel strips 410A-410E of FIG. 4. In particular, each reel strip 410A-410E provides an ordered set of game symbols 330 selected from a predetermined set of game symbols 330. In one embodiment, the predetermined symbol set consists of seven different game symbols 330, which are represented by different letters (e.g. A, B, C, D, E, F, G) for ease of illustration. However, other embodiments may utilize a predetermined symbol set consisting of a different number of game symbols 330. Moreover, the game symbols 330 may take on other shapes, such as for example, different fruits (e.g., cherries, lemons, etc.), different gems (e.g., diamonds, rubies, etc.); different cookies (e.g., sandwich, chocolate chip, etc.); different candies (e.g., candy corn, gum ball, etc.) that may align with a particular theme of the gaming machine 200.

As further shown, each reel strip 410A-410E may include an ordered symbol set consisting of a fixed number of game symbols 330 that are arranged in a predefined order. In some embodiments, each reel strip 410A-410E may include the same fixed number of game symbols 330. However, in the depicted embodiment, each reel strip 410A-410E may provide an ordered symbol set having a different fixed number of game symbols 330. The ordered symbol set of each reel strip 410A-410E may be predetermined or predefined. Moreover, the gaming machine 200 may include multiple reel sets, wherein each reel set may comprise a different number of reel strips, carry different game symbols, specify a different order of game symbols, etc. Furthermore, while the reel strips 410A-410E are depicted as a linear set of symbols, the game machine 200 utilizes the reel strips 410A-410E in a circular manner such that the first reel stop (e.g., reel stop 0 of reel strip 410A) is adjacent to the last reel stop (e.g., reel stop 16 of reel strip 410A).

Figure 5:
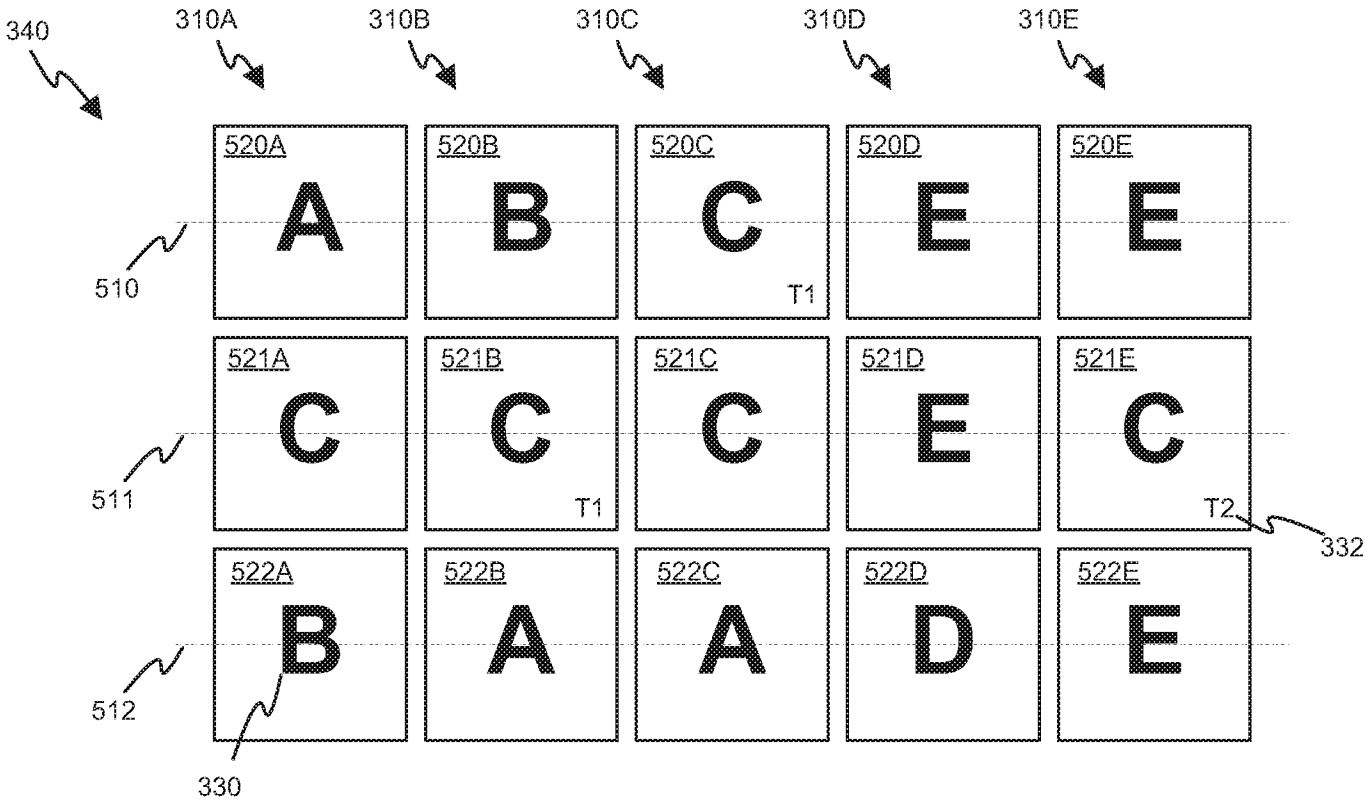
FIG. 5 depicts an exemplary symbol array or game outcome produced by the reels of FIG. 3.

Referring now to FIG. 5, further details are depicted with respect to presenting game symbols 330 and attaching tag symbols 332 to the game symbols 330. As noted above, the outer surfaces 316A-316E may carry reel strips 410A-410E having many game symbols 330, but may present only a small subset of such game symbols 330 to the player via the primary display 240. To this end, the reels 310A-310E may be physically masked or otherwise implemented such that each reel 310A-310E presents a relatively small number (e.g., three) of display positions to the player when the reels 310A-310E are stopped or otherwise at rest. For example, the first reel 310A may present three vertically disposed display positions 520A, 521A, 522A; the second reel 310B may present three vertically disposed display positions 520B, 521B, 522B; the third reel 310C may present three vertically disposed display positions 520C, 521C, 522C; the fourth reel 310D may present three vertically disposed display positions 520D, 521D, 522D; and the fifth reel 310E may present three vertically disposed display positions 520E, 521E, 522E.

As a result of such arrangement, the primary display 240 may present an 3×5 symbol array 340. While a 3×5 symbol array 340 is shown, other embodiments may include a fewer number of reels (e.g., three reels total) or greater number of reels (e.g., six reels total). Furthermore, each reel may include a different number of display positions. Moreover, while each reel 310A-310E may present the same number of symbols (e.g., three), embodiments in which not all of the reels 310A-310E present the same number of symbols are contemplated. For example, the central reel 310C in some embodiments may provide a greater number of display positions (e.g. four) than the other reels 310A, 310B, 310D, 310E.

The gaming machine 200 may utilize one or more pay lines to determine whether the symbol array 340 contains a winning symbol combination or whether the symbol array 340 contains symbols that trigger a game event. In particular, a gaming machine 200 may provide one or more pay lines and may allow the player to make a wager on each pay line in a play of the base game. For example, the gaming machine 200 may include 1, 3, 5, 9, 15, 25, or some other number of pay lines upon which the player may wager or otherwise activate. The gaming machine 200 may allow players to make wagers of substantially different amounts on each play of the primary or base game ranging, for example, from one credit up to 125 credits (e.g., five credits on each of 25 separate pay lines).

The pay lines may be horizontal (see, e.g., pay lines 510, 511, 512 of FIG. 5), vertical, circular, diagonal, angled, zigzagged, or any combination thereof. Each pay line may identify a subset of game symbols 330 or display positions of the symbol array 340. For example, FIG. 5 depicts an embodiment having three horizontal pay lines 511-512. The top pay line 510 corresponds to the top row of display positions 520A-520E. The center pay line 511 corresponds to the center row of display positions 521A-521E. The bottom pay line 512 corresponds to the bottom row of display positions 522A-522E. In one embodiment, the gaming machine 200 may spin the reels 310A-310E and award prizes if the reels 310A-310E, after stopping, present a winning combination of symbols along a pay line 511-512. In some embodiments, the pay lines 511-512 are selectively activated based on, for example, a player's wager or gaming outcomes. In such embodiments, the gaming machine 200 may award prizes and/or trigger events based on game symbols 330 aligned with activated pay lines 511-512.

While the gaming machine 200 may simulate or animate spinning reels via a primary display 240, the below description does not distinguish between animated reels and mechanical reels. Unless otherwise explicitly specified in the below description or in the appended claims, aspects of the present disclosure are applicable to gaming machines 200 having virtual reels as well as gaming machines 200 having mechanical reels.

FIG. 5 depicts the reels 310A-310E after coming to a stop or rest position to define a game outcome comprising a symbol array 340. In particular, the symbol array 500 of FIG. 5 corresponds to reel stop position (1, 2, 2, 0, 0) for the reel strips 410A-410E of FIG. 4. After coming to a stop, the gaming machine 200 may ascertain whether the symbol array 340 or game outcome contains a winning combination.

In one embodiment, the gaming machine 200 evaluates game symbols 330 from left-to-right and includes winning combinations for three or more like game symbols 330 appearing consecutively along an activated pay line. Thus, FIG. 5 depicts a single winning combination of three C symbols along the active center pay line 511. As such, the gaming machine 200 may award a prize for the three C symbols along the center pay line 512 by, for example, increasing credits on the credit meter 205 by a credit award associated with the winning combination of C symbols.

After awarding the prize for the winning combination, the gaming machine 200 may ascertain whether the symbol array 340 includes any tag symbols 332. As shown in FIG. 5, the symbol array 340 may include one or more game symbols 330 and one or more tag symbols 332 attached to some of the presented game symbols 330. The tag symbols 332 are represented by symbols T1 and T2 in FIG. 5. The gaming machine 200 may update one or more symbol meters 207 based on the presented tag symbols 332. In particular, the gaming machine 200 may award one or more bonus symbols 334 based on the presented tag symbols 332 and increment one or more symbol meters 270 to accumulate or otherwise record the quantity and/or type of each bonus symbol awarded. See, e.g., FIGS. 7 and 8A-8C for a depiction of bonus symbols 334.

Figure 6:
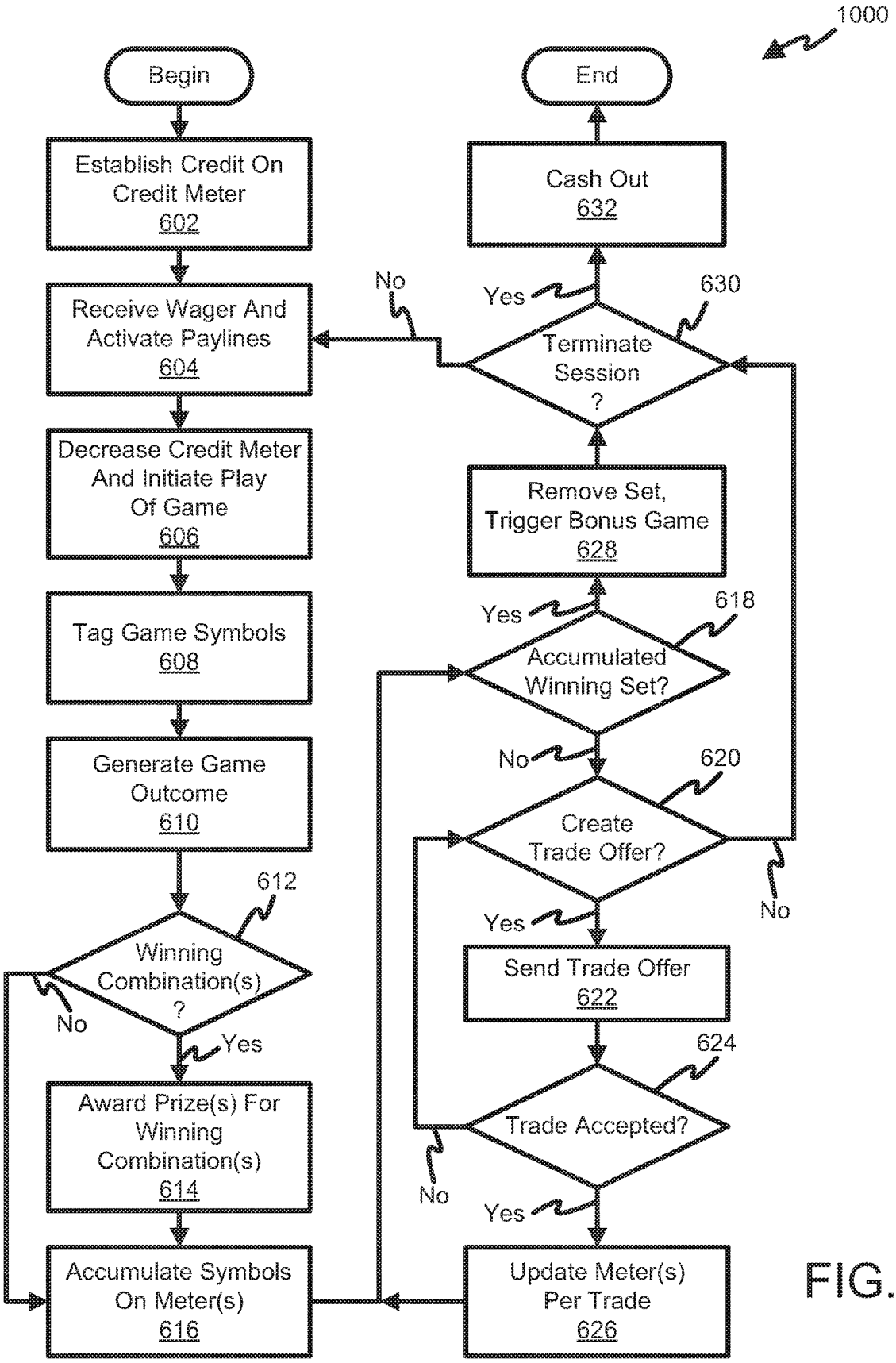
FIG. 6 depicts a flowchart of an exemplary process for playing a spinning reel game of the gaming machine of FIG. 2.

Referring now to FIG. 6, a flowchart is shown of a method 600 of playing a slot or spinning reel base game of gaming machine 200. In particular, the gaming machine 200 per the method 600 may permit cooperation between players of linked gaming machines by trading symbols used to trigger an event. The following describes the gaming machine 200 performing various tasks. However, the gaming machine 200, in various embodiments, may perform one or more such tasks as a result of one or more processors 204 of its game controller 202 executing instructions of game software or other programs 206 stored in memory 208.

Turning now to 602 of FIG. 6, the gaming machine 200 may establish a credit value on the credit meter 205. To this end, a player may insert a physical item having monetary value into the credit input mechanism 210 of the gaming machine 200. In response to the received physical item, the gaming machine 200 may increase a credit value or balance of the credit meter 205 based on the monetary value of the physical item.

At 604, the gaming machine 200 may receive a wager and may activate one or more pay lines. In particular, a player may actuate one or more buttons 208 of the gaming machine 200 to specify a value of a wager funded by the credit balance of the credit meter 205. Furthermore, in some embodiments, the gaming machine 200 may selectively activate a number of pay lines based on the specified value of the wager. In other embodiments, the gaming machine 200 may permit the player to specify via buttons 208 which pay lines to activate and a value to wager on each activated pay line.

After receiving the wager and activating one or more pay lines, the gaming machine 200 at 606 may decrease the credit meter 205 by the specified wager and initiate play of the spinning reel base game. In particular, the gaming machine 200 may initiate the base game in response to the player pressing a button 236, pulling a handle, etc. of the gaming machine 200.

At 608, the gaming machine 200 may randomly attach tag symbols 332 to one or more game symbols 330 on reel strips 410A-410E. In other embodiments, tag symbols 332 may be pre-attached to one or more game symbols 330. In such embodiment, the gaming machine 220 may forgo attaching further tag symbols 332 to game symbols 330 on the reel strips 410A-410E. Moreover, in some embodiments, the number of tag symbols 332 attached to game symbols 330 is dependent upon the amount wagered. For example, a larger wager may result in attaching a greater number of tag symbols 332 to game symbols 330 and/or may result in a greater likelihood that a game symbol 330 receives a tag symbol 332.

After attaching tag symbols 332 to game symbols 330 on the reels 310A-310E, the gaming machine 200 at 610 may generate a game outcome by spinning and then stopping the reels 310A-310E. In particular, the gaming machine 200 may determine a reel stop position based on one or more random values generated by RNG 212 to obtain a game outcome comprising a symbol array 340. In other embodiments, the gaming machine 200 may stop the reels based on information received from central determination gaming system server 106.

The gaming machine 200 at 612 may determine whether the game outcome includes a winning combination of game symbols 330 along one of the activated pay lines. If the game outcome includes a winning combination along one of the activated pay lines, then the gaming machine 200 at 614 may award a prize or prizes associated with the winning combination or combinations. In particular, the gaming machine 200 may award the prize(s) by increasing the credit value of the credit meter 205 based on the prize(s) for the winning combination(s).

Regardless of whether a winning combination is present, the gaming machine 200 at 616 may accumulate awarded bonus symbols 334 on one or more symbol meters 207. In one embodiment, the gaming machine 200 may award one or more bonus symbols 334 for each presented tag symbol 332. In such embodiments, the awarded bonus symbols 334 may be presented using different icons or other graphical depictions than the icons or graphical depictions used to present the tag symbols 332. In other embodiments, there may be a one-to-one relationship between bonus symbols 334 and tag symbols 332. In such embodiments, each bonus symbol and its respective tag symbols 332 may be presented using the same or similar icon or other graphical depiction. In some embodiments, the gaming machine 200 may award bonus symbols 334 based on a predefined winning combination of tag symbols 332 being presented in the symbol array 340.

The gaming machine 200 may add all awarded bonus symbols 334 to a single symbol meter 207, thereby accumulating all awarded bonus symbols 334 on the single symbol meter 207. In other embodiments, the gaming machine 200 may include a separate symbol meter 207 for each type of awarded bonus symbol 334. In such embodiments, the gaming machine 200 may simply increment a value of the symbol meter 207 each time its respective bonus symbol 334 is awarded.

At 618, the gaming machine 200 may determine whether the event has been triggered due to the symbol meters 207 accumulating a winning symbol set. For example, the gaming machine 200 may determine that the symbol meters 207 include a winning symbol set in response to a symbol meter 207 accumulating a predetermined number of a same bonus symbol 334, each symbol meter 207 accumulating a predetermined number of bonus symbols 334, or each symbol meter 207 accumulating its respective predetermined number of bonus symbols 334.

If the event has not been triggered, then the gaming machine 200 at 620 may determine whether the player desires to trade accumulated bonus symbols 334 with a player of a linked gaming machine. In particular, the player, via a touch screen and/or one or more buttons 236 of a player interface, may generate a trade offer. The trade offer may specify a first symbol set comprising one or more accumulated bonus symbols 334 that the player wishes to trade and a second symbol set comprising one or more accumulated bonus symbols 334 that the player wishes to receive in trade from the other player. In one embodiment, the gaming machine 200 may display a trade interface (see, e.g., FIG. 7) that shows the player not only the bonus symbols 334 accumulated by the player but also the bonus symbols 334 accumulated by players on linked gaming machines. In this manner, the player may construct a trade offer comprising only bonus symbols 334 accumulated by the two players and the gaming machine 200 may prevent the creation of invalid trade offers (e.g., offers involving bonus symbols 334 not accumulated, and/or offers involving an exchange of bonus symbol sets of unequal value). Moreover, while the gaming machine 200 may provide a trade interface that permits the player to manually specify bonus symbols 334 to be traded, the gaming machine 220 in some embodiments may suggest trade offers. In particular, the gaming machine 200 may suggest trade offers that result in one and preferably both players obtaining a winning symbol set.

The gaming machine 200 at 622 may then send the generated trade offer to the other gaming machine. As a result, the other gaming machine may present the offer to the player of the other gaming machine and prompt the player to either accept or decline the trade offer. In particular, the other gaming machine may present the player with an ACCEPT button and a DECLINE button. In response to pressing such buttons, the other gaming machine may generate and send a reply to the gaming machine 200 that indicates whether the player accepted or declined the trade offer. In some embodiments, the other gaming machine may automatically send a reply that declines the trade offer if the player fails to press one of the buttons within a timeout period (e.g. 15 seconds).

At 624, the gaming machine 200 may determine whether the trade offer has been accepted or declined based on a reply received from the other gaming machine. If the trade offer was accepted, the gaming machine 200 and the other gaming machine at 626 may update their respective symbol meters 207 per the trade offer. Thus, one or more bonus symbols 334 may be removed from the symbol meters 207 of the gaming machine 200 and added to symbol meters 207 of the other gaming machine per the trade offer. Conversely, one or more bonus symbols 334 may be removed from the symbol meters 207 of the other gaming machine and added to symbol meters 207 of the gaming machine 200 per the trade offer. After updating the symbol meters 207 at 626, the gaming machine 200 may return to 618 to determine whether the symbol meters 207 include a winning symbol set.

In response to determining that the symbol meters 207 have a winning symbol set, the gaming machine 200 at 628 may remove the bonus symbols 334 of the winning symbol set from the symbol meters 207 and trigger a game event. In the depicted embodiment, triggering the game event initiates play of a bonus game. However, in some embodiments, triggering the game event may provide the player higher awards in a base game, and/or some other benefit. After playing the bonus game and possibly receiving awards for bonus game outcomes, the gaming machine proceeds to 630 in order to provide the player with an opportunity to terminate the session. Similarly, if the gaming machine 200 at 620 determines that the player does not wish to send a trade offer, then the gaming machine 200 at 630 may determine whether the player wishes to terminate the current gaming session. For example, the player may press a button 236 of the gaming machine 200 to "cash out" and terminate the gaming session.

If the player terminates the gaming session, the gaming machine 200 at 632 may cash out any remaining credit balance on the credit meter 205 to the player via a credit output mechanism of the gaming machine. For example, the gaming machine 200 may transfer the remaining credit balance or value by dispensing the appropriate number of coins via a coin tray or by printing a ticket with the appropriate monetary value via a printer 222. If the player wishes to continue the gaming session, the gaming machine 200 may return to 604 to permit the player to adjust the wager and/or number of activated pay lines or may return to 606 to permit the player to initiate play of another game using the current established wager and activated pay lines.

Example I

Figure 7:
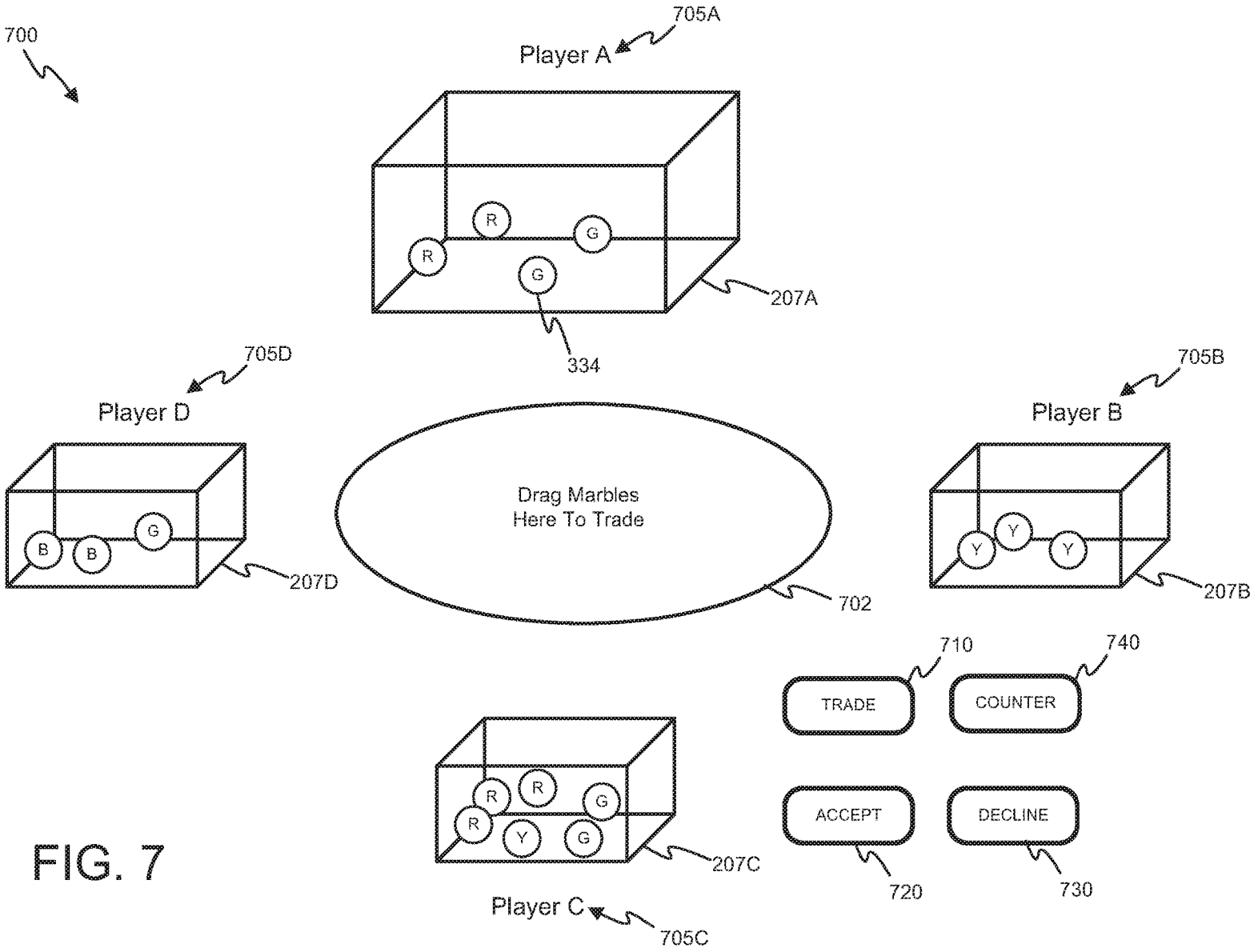
FIG. 7 depicts an exemplary trade offer interface of the gaming machine of FIG. 2.

FIG. 7 depicts a trade offer interface 700 of a gaming machine 200 linked to a bank of other gaming machines. The bank may include four gaming machines. Each gaming machine of the bank may implement the same game. Moreover, each gaming machine of the bank may be implemented in a similar manner. As such, the following describes aspects of a single gaming machine 200 of the bank; however such aspects are also applicable to the other gaming machines in the bank.

The gaming machine 200 may provide a slot or spinning reel game as described above in which awards are provided for winning combinations of game symbols 330 aligned with activated pay lines 510-512. Moreover, as explained above, the gaming machine 200 may attach tag symbols 332 to game symbols 330 of reel strips 410A-410E. In the embodiment of FIG. 7, the gaming machine 200 may attach tag symbols 332 that cause the gaming machine 200 to award bonus symbols 334 presented as red, blue, green, and yellow marbles. Such red, blue, green, and yellow marble symbols 334 are respectively depicted as R, B, G, and Y symbols 334 in FIG. 7. Moreover, the gaming machine 200 may trigger an event such as, for example, a bonus game in response to accumulating predetermined winning sets of bonus symbols 334 such as, for example, four red marbles, four blue marbles, four green marbles, four yellow marbles, or a complete set (e.g., one red, one blue, one green, and one yellow marble.)

To this end, the gaming machine 200 may randomly attach tag symbols 332 to game symbols 330 of the reel strips 410A-410E based on one or more random numbers supplied by its RNG 212 prior to spinning the reels 310A-310E. Furthermore, the gaming machine 200 may present the tag symbols 332 as small red, blue, green, and yellow marble icons that accompany the game symbols 330 of reel strips 410A-410E (e.g., icons positioned at bottom right corner, top right corner, superimposed, and/or some other relationship to the game symbol 330).

The gaming machine 200 may further present the trade offer interface 700 via the secondary display 442 such that the trade offer interface 700 includes a separate symbol meter 207A-207D for each gaming machine in the bank. In particular, each symbol meter 207A-207D may be represented as a box in which collected or accumulated bonus symbols 334 are displayed. In response to awarding bonus symbols 334 based on presented tag symbols 332, the gaming machine 200 may depict such via an animated sequence of marble icons moving from respective tag symbols 332 to appropriate symbol meter 207A-207C for the player of the gaming machine 200.

In one embodiment, the trade offer interface 700 may present the box 207A for the current gaming machine larger than the boxes 207B-207C for the linked gaming machines. The trade offer interface 700 may further identify to which player that the displayed boxes 207A-207D and their accumulated bonus symbols 334 belong. For example, the trade offer interface 700 may provide each symbol meter or box 207A-207B with an appropriate label 705A-705D such as "Player A," a character name, or a name supplied by the player of the gaming machine 200.

The trade offer interface 700 may further include a central area 702 and may present a message that informs the player that marbles may be dragged to the central area 702 to form a trade offer. In one embodiment, the gaming machines 200 may only permit trades between two gaming machines in the bank. However, other embodiments may permit trades involving more than two gaming machines and/or trades involving gaming machines from different banks. Furthermore, the gaming machines, in one embodiment, may only permit trades comprising an exchange of the same number of bonus symbols 334 and thus having an equal trade value in order to ensure fair trading. Conversely, the gaming machines may prevent the creation of invalid trade offers such as, for example, trade offers involving an exchange of bonus symbols 334 having an unequal trade value. However, other embodiments may permit trades of unequal value, thus effectively increasing the return-to-player for the player receiving the greater value and correspondingly reducing the return-to-player for the player receiving the lesser value. Thus, even when permitting trades of unequal value, the gaming machines may maintain a fixed, overall return-to-player, thus satisfying regulatory return-to-player requirements.

The trade offer interface 700 of FIG. 7 provides an exemplary game state after a period of play on the gaming machines of the bank. In particular, the trade offer interface 700 depicts a first symbol meter 207A for "Player A," a second symbol meter 207B for "Player B," a third symbol meter 207C for "Player C," and a fourth symbol meter 207D for "Player D." As shown, Player A has collected bonus symbols 334 comprising two red marbles and two green marbles, Player B has collected bonus symbols 334 comprising three yellow marbles, Player C has collected bonus symbols 334 comprising one yellow marble, two green marbles, and three red marbles, and Player D has collected bonus symbols 334 comprising two blue marbles and one green marble.

Player C may drag a green marble from the box 207C and drop it into the central area 702. The gaming machine 200 may prompt Player C to drag a marble from one of the other boxes 207A, 207B, and 207D to the central area 702. In response to such prompt, Player C may drag a red marble from the box 207A for Player A and drop it into the central area 702. Afterwards, the gaming machine 200 may display a TRADE button 710 near the central area 702. The gaming machine 200 may further present a message that prompts Player C to press the TRADE button 710 to make a trade offer or adjust the trade offer by dragging-and-dropping marbles between the central area 702 and the boxes 207A-207D.

In response to Player C pressing the TRADE button 710, the gaming machine played by Player A may present a message that summarizes the trade offer. For example, the gaming machine via a trade offer interface similar to that of FIG. 7 may display a message requesting that Player A respond by pressing an ACCEPT button 720 or a DECLINE button 730 in order to respectively accept or decline the received trade offer. The gaming machine via the trade offer interface may further indicate that Player A may generate a counter offer by dragging-and-dropping marbles between the central area 702 and the boxes 207A-207D.

Since the proposed trade offer would not result in a winning symbol set for Player A, Player A may elect to generate a counter offer. In one embodiment, the marbles that are offered for trade are marked in the boxes 207A, 207B presented to Player A and Player C. For example, the bonus symbols 334 of the trade offer may be highlighted, dimmed, or superimposed with a checkmark, dot, or other icon to identify such bonus symbols 334 as part of the trade offer.

Player A may drag a red marble from the box 207A and drop it to the central area 702. The trade offer interface may replace the ACCEPT button 720 and the DECLINE button 730 with a COUNTER button 740. In one embodiment, the gaming machine may further gray-out the displayed COUNTER button 740 since the proposed counter offer is not yet, a valid trade offer. Player A may then drag another green marble from the box 207C for Player C and drop it in the central area 702, thus resulting in a valid trade offer. In response to the valid trade offer, the gaming machine may enable the COUNTER button 740 and prompt Player A to press the COUNTER button 740 in order to send the counter offer to Player C or to keep moving marbles to adjust the counter offer.

Player A may press the COUNTER button 740 to send the counter offer to Player C. The trade offer interface 700 may present the counter offer to Player C. Moreover, the trade offer interface 700 may present the ACCEPT button 720 and the DECLINE button 730 and prompt Player C to accept or decline the presented trade offer. Player C may then press the ACCEPT button 720 in order to accept the trade offer. The gaming machines may then trade marbles per the trade offer thus resulting in Player A having a winning symbol set of bonus symbols 334 consisting of four green marbles and Player C having a winning symbol set of bonus symbols 334 consisting of four red marbles. As such, the gaming machines may remove the bonus symbols 334 of the winning symbol sets from the boxes 207A, 207C and, respectively, trigger a bonus game for Player A and a bonus game for Player C.

In some embodiments, the gaming machines trigger a bonus game selected based on the bonus symbols 334 in the winning symbol set. For example, the gaming machines may respectively trigger a "Red Bonus Game," "Green Bonus Game," "Blue Bonus Game", "Yellow Bonus Game," and a "Rainbow Bonus Game" for red, green, blue, yellow, and multi-color winning symbol sets. In such embodiments, each of the bonus games may provide the same return-to-player or expected value to ensure fairness among the trades.

Example 2

Figure 8A:
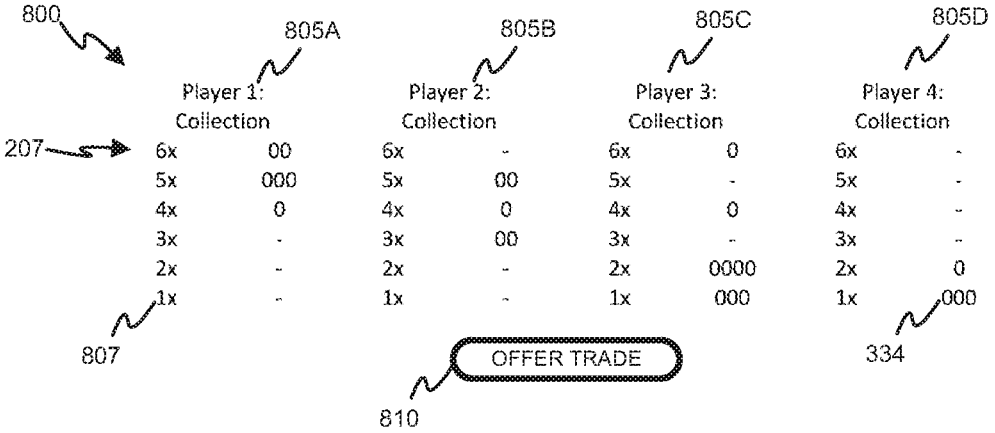
FIGS. 8A-8C depict aspects of another exemplary trade offer interface of the gaming machine of FIG. 2.
Figure 8B:
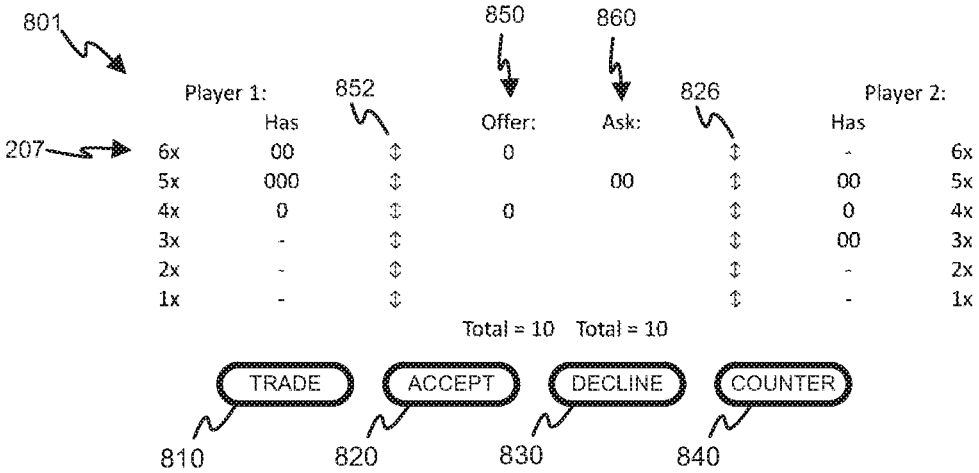
Figure 8C:
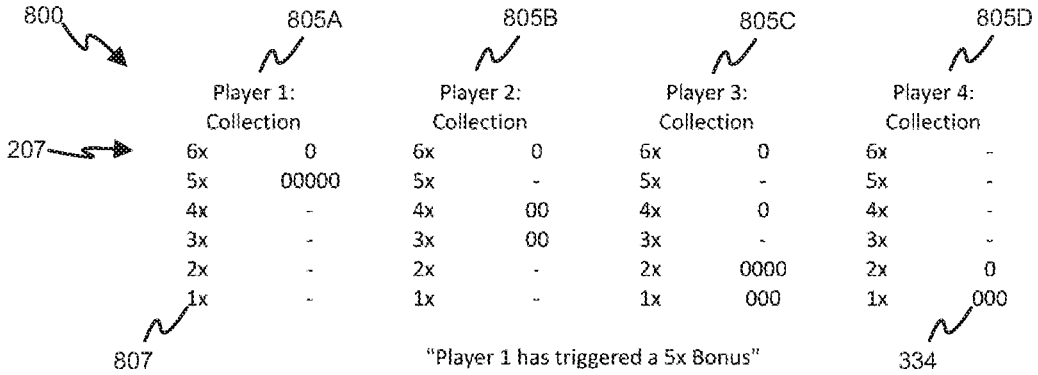

Referring now to FIGS. 8A-8C, another embodiment of a trade offer interface 800 is shown in which symbol meters 207 accumulate bonus symbols 334 associated with multipliers. Similar to EXAMPLE 1, the gaming machine 200 may attach tag symbols 332 to the game symbols 330 that are represented by multiplier icons (e.g., ×1, ×2, ×3, ×4, ×4, ×6) at the start of a spin of the reels 310A-310E.

The gaming machine 200 may trigger an event in response to accumulating five of the same multiplier bonus symbol 334. In one embodiment, the multipliers and respective bonus symbols 334 range from ×1 to ×6. Moreover, the gaming machine 200 may provide bet levels ranging from 1 to 5. For example, a gaming machine 200 that costs a minimum 40 credits to play and may provide options to wager 40, 80, 120, 160, or 200 credits.

Once a player has accumulated a winning symbol set of bonus symbols 334 consisting of five matching multipliers, the gaming machine 200 may remove the bonus symbols 334 of the winning symbol set from the symbol meters 207A-207B and trigger a bonus game with the associated multiplier in effect.

Unlike EXAMPLE 1, the gaming machine 200 per EXAMPLE 2 may attach tag symbols 332 to the game symbols 330 based on two RNGs 212 and an amount wagered. The amount wagered and the first RNG 212 may specify a quantity of tag symbols 332 to be attached per the following TABLE 1.

TABLE 1

| | Bet Level 1 | | Bet Level 2 | | Bet Level 3 | | Bet Level 4 | | Bet Level 5 | |
|---|---|---|---|---|---|---|---|---|---|---|
| # Tags | Weight | Prob | Weight | Prob | Weight | Prob | Weight | Prob | Weight | Prob |
| 0 | 20 | 0.5 | 10 | 0.33333 | 10 | 0.33333 | 10 | 0.33333 | 5 | 0.17857 |
| 10 | 10 | 0.25 | 10 | 0.33333 | 10 | 0.33333 | 10 | 0.33333 | 11 | 0.39286 |
| 20 | 10 | 0.25 | 10 | 0.33333 | 10 | 0.33333 | 10 | 0.33333 | 12 | 0.42857 |
| AVERAGE | 7.5 | | 10 | | 10 | | 10 | | 12.5 | |

The amount wagered and the second RNG 212 may specify which tag symbols 332 are to be attached per the following TABLE 2.

TABLE 2

| | Bet Level 1 | | Bet Level 2 | | Bet Level 3 | | Bet Level 4 | | Bet Level 5 | |
|---|---|---|---|---|---|---|---|---|---|---|
| Multiplier | Weight | Prob | Weight | Prob | Weight | Prob | Weight | Prob | Weight | Prob |
| 1 | 20 | 0.66667 | 7 | 0.25 | 2 | 0.0625 | 0 | 0 | 0 | 0 |
| 2 | 5 | 0.16667 | 11 | 0.39286 | 5 | 0.15625 | 2 | 0.0625 | 0 | 0 |
| 3 | 5 | 0.16667 | 6 | 0.21429 | 10 | 0.3125 | 4 | 0.125 | 20 | 0.14706 |
| 4 | | 0 | 4 | 0.14286 | 10 | 0.3125 | 10 | 0.3125 | 40 | 0.29412 |
| 5 | | 0 | | 0 | 4 | 0.125 | 8 | 0.25 | 64 | 0.47059 |
| 6 | | 0 | | 0 | 1 | 0.03125 | 8 | 0.25 | 12 | 0.08824 |
| AVERAGE | 1.5 | | 2.25 | | 3.375 | | 4.5 | | 4.5 | |
| Product | 11.25 | | 22.5 | | 33.75 | | 45 | | 56.25 | |

The weights presented in the above TABLE 1 and TABLE 2 provide bonus symbols 334 to trade in a manner that is fair regardless of bet level. In particular, the product of the average number of tags attached and the average multiplier for each bet level increases proportionally with respect to the bet level.

For example, at bet level 1, the gaming machine 200 attaches on average 7.5 tag symbols 332 to game symbols 330 of the reel strips 410A-410E per TABLE 1. Moreover, the gaming machine 200 selects such 7.5 tag symbols 332 per TABLE 2 such that each tag symbol 334 provides a 1.5 multiplier on average. Thus, at bet level 1, the gaming machine 200 per TABLES 1 and 2 attaches tag symbols 332 to game symbols 330 of the reel strips 410A-410E that provide a benefit in proportion to 11.25 (7.5 times 1.5). However, at bet level 5, which is five times greater than bet level 1, the gaming machine 200 attaches on average 12.5 tag symbols 332 to the game symbols 330 of the reel strips 410A-410E per TABLE 1. Moreover, the gaming machine 200 selects such 12.5 tag symbols 332 per TABLE 2 such that each tag symbol 332 provides a 4.5 multiplier on average. Thus, at bet level 5, the gaming machine 200 per TABLES 1 and 2 attaches tag symbols 332 to game symbols 330 of the reel strips 410A-410E with tag symbols 332 that provide a benefit in proportion to 56.25 (12.5 times 4.5), which is five times greater than the benefit provided for bet level 1.

Thus, the gaming machine 200 at the start of each spin may attach tag symbols 332 to game symbols 330 per TABLES 1 and 2. When a tag symbol 332 appears in the symbol array 340, the gaming machine 200 may award and accumulate a corresponding bonus symbol 334 to a symbol meter 207 used to record that particular type of bonus symbol 334. For example, each player may have a 6× meter 207, a 5× meter 207, a 4× meter 207, a 3× meter 207, a 2× meter 207, and a 1× meter 207 to respectively record ×6, ×5, ×4, ×3, ×2, ×1 bonus symbols 334.

Because the collections may be large, implementing the trade offer interface 800 per the trade offer interface 700 of FIG. 7 may not be practical. As such, the trade offer interface 800 provides a more concise depiction of the bonus symbols 334 collected by the gaming machines in the bank of gaming machine. In particular, the trade offer interface 800 may provide a label 805A-805D for each player and may list each player's collection by depicting a multiplier icon 807 for each type of multiplier tag symbols 332 and a number of small bonus symbols 334 indicating how many of the respective bonus symbol 334 that the player has collected. See, e.g., FIGS. 8A and 8C.

The trade offer interface 800 may further include an OFFER TRADE button 811. A player may touch or otherwise active the OFFER TRADE button 811 to initiate the creation of a trade offer. In particular, when the button 811 is activated, the gaming machine 200 may prompt the player to select the player with which they wish to trade. For example, the player may simply touch or otherwise activate the label 805A-805D associated with the player with which they wish to trade.

In response to such selection, the gaming machine 200 may replace the trade offer interface 800 with the trade creation interface 801 shown in FIG. 8B. The trade creation interface 801 depicts the symbol meters 207 for the trade initiating player and the selected player. The trade creation interface 801 may further include an OFFER column 850 and an ASK column 860. Each column 850, 860 includes a spinner widget 852, 862 associated with each symbol meter 207. Via such spinner widgets 852, 862, the player may increment or decrement the respective tag symbols 332 being offered or the respective tag symbols 332 being asked for or requested.

In this example, the gaming machine 200 may permit trades of unequal values. However, if it were desirable to enforce equitable trades, the gaming machine 200 may require the numerical total of the multipliers be the same in the ASK and the OFFER. For example, in FIG. 8B, the player has created a trade offer comprising an OFFER of one ×6 bonus symbol 334 and one ×4 bonus symbol 334 and an ASK of two ×5 bonus symbols 334. Because all players, in the presented embodiment, play the same version of the bonus game and because the multiplier in effect when they play is linearly proportional to the sum of the bonus symbols triggering the multiplier, all collections of bonus symbols that sum to the same numeric value have the same benefit value. Thus, the created trade offer is fair in that the value of both the OFFER (×6+×4) and the ASK (×5+×5) is ×10.

In one embodiment, created trade offers may be accepted, rejected, or amended in a manner similar to the trade offer interface 700 of EXAMPLE 1. For example, the trade creation interface 801 may provide a TRADE button 810, an ACCEPT button 820, a DECLINE button 830, and a COUNTER button 840, which may respectively operate in a manner similar to the TRADE button 710, the ACCEPT button 720, the DECLINE button 730, and the COUNTER button 740 of the trade offer interface 700.

FIG. 8C depicts the symbol meters 207 of FIG. 8A after the trade offer of FIG. 8B is accepted. As further shown, the accepted trade has resulted in Player 1 triggering a 5× Bonus due to the winning symbol set of bonus symbols 334 consisting of five accumulated ×5 symbols.

In some embodiments, the gaming machine 200 in response to a triggered event may apply the collected multiplier to the very next spin of the reels 310A-310E. In such an embodiment, the gaming machine 200 may require that the obtained multiplier be used at the same bet level at which it was acquired. Alternatively, the gaming machine 200 may adjust the obtained multiplier based on the bet level. For example, a ×3 instant spin collected while playing at bet level 4 would have the same value (4×3=12) as a ×6 multiplier at a bet level 2 (2×6=12).

The present disclosure describes exemplary embodiments. Modifications of the above disclosed apparatus and methods which fall within the scope of the appended claims will be readily apparent to those of ordinary skill in the art. For example, although the examples discussed above are illustrated for a gaming market, embodiments of the disclosure can be implemented for other markets. Accordingly, while the present disclosure has set forth various exemplary embodiments, other embodiments may fall within the spirit and scope of the following claims.

What is claimed is:

1. A gaming machine from a plurality of linked gaming machines, the gaming machine comprising:

a credit input mechanism configured to receive a physical item representing a monetary value;

a display device;

one or more symbol meters;

a player interface; and a game controller that executes instructions from a memory, the instructions causing the game controller to at least:

increase a credit balance of a credit meter based on the monetary value of the physical item received by the credit input mechanism;

decrease the credit balance based on a wager on a game outcome;

randomly generate the game outcome;

cause the display device to display the game outcome;

award one or more bonus symbols based on the game outcome;

accumulate, among the one or more symbol meters, the one or more bonus symbols awarded based on the game outcome;

after the one or more bonus symbols are accumulated among the one or more symbol meters, create, based on input signals received from the player interface, a request to substitute a first set of bonus symbols accumulated among the one or more symbol meters for a second set of bonus symbols accumulated by another gaming machine from the plurality of linked gaming machines;

send the request to the another gaming machine;

in response to receiving an acceptance of the request from the another gaming machine:

remove the first set of bonus symbols accumulated by the gaming machine from the one or more symbol meters of the gaming machine; and add the second set of bonus symbols accumulated by the another gaming machine to the one or more symbol meters of the gaming machine; and trigger an event in response to the one or more symbol meters accumulating a winning set of bonus symbols; and increase the credit balance based on an award associated with the game outcome.

2. The gaming machine of claim 1, wherein the instructions further cause the game controller to play a bonus game in response to triggering the event.

3. The gaming machine of claim 1, wherein the instructions further cause the game controller to remove the winning set of bonus symbols from the one or more symbol meters.

4. The gaming machine of claim 1, wherein the instructions further cause the game controller to determine that the one or more symbol meters includes the winning set of bonus symbols in response to the one or more symbol meters accumulating a predetermined number of a same bonus symbol.

5. The gaming machine of claim 1, wherein the instructions further cause the game controller to determine that the one or more symbol meters includes the winning set of bonus symbols in response to each symbol meter from the one or more symbol meters accumulating a predetermined number of bonus symbols.

6. The gaming machine of claim 1, wherein instructions further cause the game controller to determine that the one or more symbol meters includes the winning set of bonus symbols in response to a symbol meter from the one or more symbol meters accumulating its respective predetermined number of bonus symbols.

7. The gaming machine of claim 1, wherein the first set of bonus symbols includes a first bonus symbol and the second set of bonus symbols includes a second bonus symbol that is different than the first bonus symbol.

8. The gaming machine of claim 1, wherein the first set of bonus symbols comprises of a first plurality of bonus symbols and the second set of bonus symbols comprises a second plurality of bonus symbols that are different than the first plurality of bonus symbols.

9. The gaming machine of claim 1, wherein the first set of bonus symbols has a first value and the second set of bonus symbols has a second value equal to the first value.

10. The gaming machine of claim 1, wherein the instructions further cause the game controller to:

randomly attach one or more tag symbols to a plurality of game symbols;

randomly generate the game outcome based on the plurality of game symbols and the attached one or more tag symbols;

award the one or more bonus symbols based on the attached one or more tag symbols of the game outcome; and determine the award associated with the game outcome based on game symbols of the game outcome.

11. The gaming machine of claim 1, wherein:

a first symbol meter of the one or more symbol meters is configured to accumulate a multiplier symbol; and the instructions further cause the game controller to:

determine that the one or more symbol meters have accumulated the winning set of bonus symbols in response to the first symbol meter accumulating a predetermined number of the multiplier symbol; and in response to the first symbol meter accumulating the predetermined number of the multiplier symbol, play a game in which awards are multiplied by a multiplier associated with the multiplier symbol.

12. A method for playing a game of a gaming machine from a plurality of linked gaming machines, the method comprising:

increasing a credit balance of a credit meter of the gaming machine based on a monetary value of a physical item received by a credit input mechanism of the gaming machine;

decreasing the credit balance based on a wager on a game outcome of the gaming machine;

randomly generating the game outcome with a game controller of the gaming machine;

displaying the game outcome on a display device of the gaming machine;

awarding one or more bonus symbols based on the game outcome;

accumulating, among one or more symbol meters of the gaming machine, the one or more bonus symbols awarded based on the game outcome;

after said accumulating, creating, based on input signals received via a player interface of the gaming machine, a request to substitute a first set of bonus symbols accumulated by the one or more symbol meters for a second set of bonus symbols accumulated by another gaming machine from the plurality of linked gaming machines;

sending the request to the another gaming machine;

in response to receiving an acceptance of the request from the another gaming machine:

removing the first set of bonus symbols accumulated by the gaming machine from the one or more symbol meters of the gaming machine; and adding the second set of bonus symbols accumulated by the another gaming machine to the one or more symbol meters of the gaming machine; and triggering an event in response to the one or more symbol meters accumulating a winning set of bonus symbols; and increasing the credit balance based on an award associated with the game outcome.

13. The method of claim 12, further comprising playing a bonus game in response to said triggering the event.

14. The method of claim 12, further comprising determining that the one or more symbol meters includes the winning set of bonus symbols in response to the one or more symbol meters accumulating a predetermined number of a same bonus symbol.

15. The method of claim 12, further comprising determining that the one or more symbol meters includes the winning set of bonus symbols in response to a symbol meter from the one or more symbol meters accumulating its respective predetermined number of bonus symbols.

16. The method of claim 12, further comprising preventing a substitution of the first set of bonus symbols for the second set of bonus symbols in response to determining that the request is invalid.

17. The method of claim 16, further comprising determining that the request is invalid in response to a first value of the first set of bonus symbols being different than a second value of the second set of bonus symbols.

18. The method of claim 12, wherein:

said randomly generating the game outcome comprises randomly attaching one or more tag symbols to a plurality of game symbols and randomly generating the game outcome based on the plurality of game symbols and the attached one or more tag symbols; and the method further comprises awarding the one or more bonus symbols based on the attached one or more tag symbols of the game outcome.

19. The method of claim 18, further comprising determining the award associated with the game outcome based on game symbols of the game outcome.

20. The method of claim 12, wherein:

said accumulating comprises accumulating a multiplier symbol on a first symbol meter of the one or more symbol meters; and the method further comprises:

determining that the one or more symbol meters have accumulated the winning set of bonus symbols in response to the first symbol meter accumulating a predetermined number of the multiplier symbol; and in response to the first symbol meter accumulating the predetermined number of the multiplier symbol, playing a game in which awards are multiplied by a multiplier associated with the multiplier symbol.

* * * * *